United States Patent [19]

Renaud et al.

[11] 4,040,989

[45] Aug. 9, 1977

[54] LIQUID DETERGENT

[75] Inventors: Jean Renaud, Bougival; Jean-Paul Narcy, Paris, both of France

[73] Assignee: Colgate-Palmolive Company, New York, N.Y.

[21] Appl. No.: 469,382

[22] Filed: May 13, 1974

[30] Foreign Application Priority Data

May 25, 1973 France ..... 73.19155

[51] Int. Cl.[2] ..... C11D 1/86

[52] U.S. Cl. ..... 252/548; 252/536; 252/539; 252/540; 252/529; 252/559; 252/555; 252/DIG. 1; 252/DIG. 14

[58] Field of Search ..... 252/546, 548, DIG. 14, 252/DIG. 1, 559, 540, 539, 99, 321, 358, 536, 529, 555

[56] References Cited

U.S. PATENT DOCUMENTS

| | | | |
|---|---|---|---|
| 2,298,650 | 10/1942 | Samaras et al. | 252/559 |
| 3,118,000 | 1/1964 | Dupré et al. | 252/DIG. 1 |
| 3,501,409 | 3/1970 | Matson et al. | 252/559 X |
| 3,523,902 | 8/1970 | Schmolka | 252/137 |
| 3,548,056 | 12/1970 | Eigen et al. | 252/544 X |
| 3,609,089 | 9/1971 | Cantrell et al. | 252/548 |
| 3,676,374 | 7/1972 | Zaki et al. | 252/552 X |
| 3,707,503 | 12/1972 | Kenny | 252/117 |

FOREIGN PATENT DOCUMENTS

| | | | |
|---|---|---|---|
| 690,676 | 7/1964 | Canada | 252/559 |

*Primary Examiner*—Mayer Weinblatt
*Assistant Examiner*—Charles R. Wolfe, Jr.
*Attorney, Agent, or Firm*—Richard N. Miller; Murray M. Grill; Herbert S. Sylvester

[57] ABSTRACT

A liquid detergent, suitable for hand dishwashing and of excellent washing properties which produces a medium foam that is long lasting in the presence of greasy soil and which comprises a ternary mixture of an anionic detergent which is a paraffin sulfonate or linear alkyl benzene sulfonate or a mixture thereof; a nonionic detergent which is either a condensate of higher fatty alcohol with a heteric mixture of ethylene and propylene oxides or a lower alkyl ether of an alkyl phenoxy polyethoxy lower alkanol or a mixture thereof; and an alkanoic acid alkanolamide in water. The liquid is in concentrated form, containing at least 35% by weight of the ternary mixture.

7 Claims, No Drawings

LIQUID DETERGENT

This invention relates to liquid detergents. More particularly, it relates to liquid detergents suitable for washing by hand (as opposed to compositions employed in automatic dishwashing machines) which are excellent detergents, and which exhibit desired controlled, persistent foaming characteristics in the presence of fatty or greasy soil.

Foam generation by detergents has long been considered as a sign of detersive ability. With the advent of automatic laundry washing and dishwashing machines excessive foams sometimes caused poor washing, due to mechanical "clogging" in the machine and prevention by the foam of the washing fluid efficiently contacting all of the materials or items being cleaned. However, despite the education of the consumer to accept low foaming detergents intended for use with automatic washing machines and diswashers it has generally been accepted by the detergent industry and the consumer that high foaming dishwashing products intended for use by hand are preferable. Yet, such products possess disadvantages, sometimes having such a copious foam that adheres to the dishes and prevents the person washing them from being able to observe whether or not they are clean. Also, sometimes such copious foams require additional rinsing to remove them and if such rinsing is not effected water or detergent spots are left on the washed dinnerware. A particularly aggravating task is rinsing down the drain all foam left in the sink after washing of dishes. Excessive amounts of foam also limit the capacity of the sink, wash basin or dishpan in which the dishes are being soaked or held prior to cleaning. In the past these various disadvantages have been tolerated by consumers because they were considered to be necessary results accompanying the use of effective dishwashing liquids having persistent foaming ability and good detergency in use.

Now, however, the present applicants have discovered concentrated liquid detergent compositions suitable for land dishwashing which possess medium to medium-low persistent foaming characteristics and which satisfactorily clean a great number of plates, being as effective as or more effective than commercial, concentrated, high foaming liquid detergents in cleaning power and persistence of foam. It has been found in extensive comparative tests that consumers (housewives) significantly prefer such compositions and their foaming properties to the most popular of the commercial dishwashing detergents sold in France.

In accordance with the present invention, the liquid dishwashing detergent comprises a mixture of:

a. an anionic detergent which is a paraffin sulfonate or a linear alkyl benzene sulfonate or a mixture thereof;

b. a nonionic detergent which is a condensate of a higher fatty alcohol with a heteric mixture of ethylene and propylene oxides or a lower alkyl ether of an alkyl phenoxy poly-lower alkoxy lower alkanol, or a mixture thereof;

c. a lower alkanolamide of a higher alkanoic acid; and d. water; the total of (a), (b) and (c) being at least 35% by weight of the composition.

In the most preferred embodiments of the invention the anionic detergent is sodium paraffin sulfonate averaging about 15 carbon atoms in the paraffin group or sodium linear alkyl benzene sulfonate in which the alkyl averages about 11 carbon atoms, the nonionic detergent is a higher fatty alcohol (12 to 15 carbon atoms) heteric ethylene oxide-propylene oxide condensate wherein the ethylene oxide:propylene oxide weight ratio is about 3 to 1 and the alkylene oxide content is about 75%, or a tertiary butyl ether of tertiary octyl phenoxy polyethoxy ethanol wherein the polyethoxy moiety is of about 11.5 ethoxy groups, the alkanoic acid alkanolamide is lauric myristic monoethanolamide and the total of such constituents in the composition is from about 40 to 45%.

The water soluble paraffin sulfonates employed in the present invention are usually mixed secondary alkyl sulfonates having from 10 to 20 carbon atoms per molecule with at least about 80% thereof being either 12 to 18 carbon atoms per molecule or 10 to 17 carbon atoms per molecule. A preferred range of carbon atom contents is from 14 to 17 carbon atoms with an average carbon atom content of about 15. The preferred molecular weight normally ranges from 300 to 350.

The described paraffin sulfonates are preferably prepared by subjecting a cut of paraffin, corresponding to the chain length specified above, to the action of sulfur dioxide and oxygen in accordance with the well known sulfoxidation process. The product of this reaction is a secondary sulfonic acid, which is then neutralized with a suitable base to produce the water soluble secondary alkyl sulfonate. Similar useful secondary alkyl sulfonates may be obtained by other methods, e.g., by the sulfochlorination technique, in which chlorine and sulfur dioxide are reacted with paraffin in the presence of actinic light, with the resulting sulfuryl chlorides being hydrolyzed and neutralized to form the secondary alkyl sulfonates.

The cation of the paraffin sulfonate and of the other anionic sulfonates to be described below is preferably an alkali metal, ammonium or lower alkanolamine, although alkaline earth metals, e.g., magnesium, and lower amines are also useful in forming the water soluble detergent salts. The better of the alkali metals are sodium and potassium, with sodium being preferred. The lower alkanolamines may be mono-, di- or trialkanolamines containing 1 to 3 carbon atoms in the alkanol group, and most preferably, ethanolamines, e.g., triethanolamine and diethanolamine. The corresponding amines may be used instead. The most preferred of the paraffin sulfonates is the sodium paraffin sulfonate wherein the paraffin is essentially (80% or more and preferably 95% or more) of a molecular weight of about 330.

The linear alkyl benzene sulfonate is of 8 to 15 carbon atoms in the linear alkyl group, preferably of 10 to 12 carbon atoms and most preferably averages about 11 carbon atoms. The most preferred alkyl benzene sulfonate is sodium undecyl benzene sulfonate having at least 80% of alkyls of 10 to 12 carbon atoms. Such compounds may be made by alkylation of benzene, followed by sulfonation and neutralization according to well known techniques.

The nonionic detergent which is a condensate of a higher fatty alcohol with a heteric mixture of ethylene and propylene oxides is one in which the higher fatty alcohol is of 10 to 16 carbon atoms, preferably with at least 80% thereof of 12 to 15 carbon atoms. The proportion of ethylene oxide to propylene oxide is from 2.5:1 to 4:1, preferably from 2.8:1 to 3.3:1 and most preferably about 3:1, with the total of the ethylene oxide and propylene oxide contents (including the terminal ethanol or propanol group), being from 60 to 85%, preferably 70 to 80% and most preferably about 75% of the nonionic detergent molecular weight.

The lower alkyl ether of alkyl phenoxy polylower alkoxy lower alkanol is one wherein the lower alkyl and lower alkanol are of 2 to 6 carbon atoms, the polylower alkoxy is polyethoxy (9 to 14 of which ethoxies are present per mole) and the alkyl is of 6 to 10 carbon atoms. Preferably, at least 80% of the material will have the lower alkyl of the lower alkyl ether of 3 to 5 carbon atoms, the lower alkanol being ethanol, the poly-lower alkoxy being polyethoxy and the alkyl being of 7 to 9 carbon atoms. Most preferably the lower alkyl of the ether is tertiary butyl, the alkyl is tertiary octyl and the polyethoxy moiety is of about 11.5 ethoxy groups.

The lower alkanolamide of higher alkanoic acid is employed primarily for its foaming and foam stabilizing effects and is the reaction product of a lower alkanol of 2 to 3 carbon atoms and an alkanoic acid of 10 to 16 carbon atoms, preferably with 80% or more of the lower alkanol being ethanol and a similar proportion of the alkanoic acid being of 12 to 14 carbon atoms. Other lower alkanols that are also useful are n-propanol and isopropanol. The preferred alkanoic acid is a mixture of lauric and myristic acids, generally in proportions of 1:2 to 2:1, with about 50% of each being preferable. Alternatively, coconut oil or hydrogenated coconut oil may be used as a source of the alkanoic acids. Suitable alkanoic acid alkanolamides include the monoethanolamides, diethanolamides and the monoisopropanolamides.

In place of a part of the alkanoic acid alkanolamide content of the present compositions, trialkyl amine oxides or lower alkoxylated alkanoic acid alkanolamides may be employed. The amine oxides are usually dilower alkyl higher alkyl amine oxides wherein the lower alkyls are of 1 to 3 carbon atoms and the higher alkyls contain from 10 to 16, preferably 12 to 14 carbon atoms. The alkoxylated alkanoic acid alkanolamide has from 1 to 10, preferably 2 to 4 ethoxy groups in the molecule. The alkanol and the fatty acid are the same as for the present alkanoic acid alkanolamides. Normally, the replacement of alkanolamide will be to the extent of only 5 to 40% by weight of the proportions thereof given in this specification. While the alkanolamide may be completely replaced by the amine oxide, ethoxylated alkanolamide or mixture thereof, such complete replacement is not preferred.

Various other materials may also be included in the present compositions for their desirable functional or aesthetic effects. Among the more important of these are materials employed to increase the mildness of the detergent composition to the human hands. Of such compounds the water soluble proteins are highly preferred. Chemically, such materials are low molecular weight polypeptides obtained by hydrolysis of protein materials such as human and animal hair, horns, hides, hooves, gelatin, collagen and the like. A particularly preferred water soluble protein is made by the hydrolysis of pork protein. During hydrolysis the proteins are gradually broken down into their constituent polypeptides and acids by prolonged heating with acids, e.g., $H_2SO_4$, or alkalis, e.g., NaOH, or by treatment with enzymes, e.g., peptidases. During hydrolysis high molecular weight polypeptides are formed first as hydrolysis products, which are converted progressively to simpler and simpler peptides, e.g., tripeptides, dipeptides and finally, to amino acids. The polypeptides derived from proteins are complex mixtures and in practice the average molecular weight of the hydrolysate will vary from 120 (amino acids) to about 20,000. All satisfactory hydrolyzed polypeptides are characterized by water solubility. In compositions which contain soluble protein it is often preferred to employ hydrolyzed collagen of such low molecular weight as to be completely soluble in water, non-gelling (exhibiting zero Bloom value) and being non-denaturing, with an average molecular weight below 15,000, preferably in the range of about 500 to 10,000.

Other constituents of the present compositions include urea, normally employed as the technical product, and $C_2$–$C_3$ lower alcohol, preferably ethanol (may be denatured), although isopropanol is also useful. The urea aids in solubilizing various components of the composition and often desirably modifies the viscosity. The lower alcohol or other suitable solvent employed has a thinning effect on the composition and of course, helps solubilize constituents thereof. Although solvents, including water, tend to make the products clear liquids, it is sometimes desirable to opacity them or make them appear pearly. For such purpose there may be employed opacifying agents, e.g., behenic acid, or a pearlescent or pearlizing composition, such as an approximately equal mixture of higher fatty acid ester of polyethoxy ethanol, coconut oil fatty acid alkanolamide and sodium lauryl ether sulfate. The higher fatty acid will usually be of 10 to 18 carbon atoms and the polyethoxy content will be of 1 to 20, preferably 1 to 10 ethoxy groups. The alkanolamide will preferably be ethanolamide, but can be mixed with isopropanolamide, too. Additional adjuvant components of the present compositions include perfumes; sequestrants, e.g., tetrasodium ethylene diamine tetracetate, trisodium nitrilotriacetate; bactericides, e.g., trichlorocarbanilide, tetrachlorosalicylanilide, hexachorophene, chlorobromasalicylanilide; antioxidants; thickeners, e.g., sodium carboxymethyl cellulose, polyacrylamide, Irish moss; dyes; water dispersible pigments; salts, e.g., sodium sulfate, magnesium sulfate, as the heptahydrate or anhydrous, sodium chloride; and additional solvents.

In the above description of the compositions of this invention and the various adjuvants employable therein, and in the claims, although individual constituents are mentioned for various classes or types of components it is within the invention that mixtures thereof be employed, such as mixtures of two or three anionic detergents or mixtures of the nonionic detergents, both possibly with other anionic and nonionic detergents known in the art, mixtures of skin treating materials and mixtures of solvents, among others.

The proportions of the various components are important to the success of the invention and the utilities of the invented products. For best results the concentrated liquid dishwashing detergents should contain at least a total of 35% by weight of the mixture of the anionic detergent, nonionic detergent and alkanoic acid alkanolamide components, the proportion of alkanoic acid alkanolamide being calculated exclusive of any that may be present with the pearlizing mixture. Preferably, the content of the mentioned materials is 35 to 55% by weight of the composition, more preferably 35 to 50% and most preferably 40 to 45% by weight. The weight proportion of the paraffin sulfonate component is about 20 to 40% of the liquid detergent, preferably 25 to 40% thereof and most preferably, in a particular formula, about 32%. Similarly, the weight proportion of the linear alkyl benzene sulfonate is also 15 or 20 to 40% of the liquid detergent, preferably 15 to 30% thereof. In short, the proportion of anionic synthetic organic detergent utilized is about 20 to 40 % by weight, but as little as 15% may be employed, especially when the anionic detergent is linear alkyl benzene sulfonate. The proportion of nonionic detergent will normally be from 5 to 30% by weight of the product, with 5 to 15% by weight of the higher fatty alcohol-ethylene oxide-propylene oxide condensate often being preferred and 5 to 15% by weight of the tertiary butyl ether of tertiary octyl phenoxy polyethoxy ethanol being preferred in some formulas and 15 to 30% by weight of such material preferred in others. In a specific formula of the former type, about 9% of this nonionic is preferable. The weight ratio of anionic to nonionic detergents in the product is usually in the range of 0.8:1 to 5:1, preferably from 0.9:1 to about 4:1.

The alkanoic acid alkanolamide component is generally from 1 to 8% by weight of the liquid detergent, preferably 2 to 5% and most preferably about 2–3% by weight.

The water soluble protein will normally be from 0.5 to 3%, preferably about 0.8 to 2%, e.g., 1% by weight. The proportion of solvents or solubilizers present may vary widely and may be determined by the formulator by conventional tests. For example, from 0 to 20% by weight of ethanol or other solvent, e.g., isopropanol, may be employed with from 1 to 5% by weight of ethanol being satisfactory. Additionally, up to 8% normally 2 to 8% and preferably 4 to 6% by weight of urea solubilizer may be employed. Best results may be achieved with mixtures of preferred proportions of ethanol and urea. When magnesium sulfate heptahydrate is present the proportion thereof will usually be from 1 to 5%, preferably about 2% by weight. The employment of pearlizing mixtures will normally be to the extent of about 5 to 15% by weight with 6 to 10% being preferred and about 8% being most preferred. Other adjuvants will generally be limited to 20%, preferably to 10%, and most preferably to 5% by weight. Most desirably, each adjuvant will total less than 5% by weight of the product and ofter the individual adjuvants themselves will be present to the extent of less than 2% by weight each, more preferably less than 1% each and most preferably, in many cases, less than 0.5%.

The balance of the composition will be an aqueous medium which is preferably water or water containing minor proportions of other solubilizing materials. Normally, however, it will be better to use distilled or deionized water. The proportion thereof will normally be from 30 to 65% by weight of the liquid detergent, preferably 40 to 60% by weight.

In specific preferred formulas there are present by weight from 25 to 40% of the paraffin sulfonate, 5 to 15% of higher fatty alcohol-alkylene oxide condensate, 1 to 5% of lauric myristic monoethanolamide, 2 to 8% of urea, 0.5 to 3% of water soluble protein, 1 to 5% of magnesium sulfate heptahydrate and 5 to 15% of pearlizing mixture, already described; 15 to 30% of sodium linear alkyl benzene sulfonate, 15 to 30% of tertiary butyl ether of tertiary octyl phenoxy polyethoxy ethanol, 1 to 5% of lauric myristic monoethanolamide, 0.5 to 3% of water soluble protein, 2 to 8% of urea and 1 to 5% of ethanol; and 25 to 40% of paraffin sulfonate, 5 to 15% of the tertiary butyl ether compound, 1 to 5% of lauric myristic monethanolamide and 0 to 20% of functional or aesthetic adjuvants; with the balance in all cases being water, preferably deionized.

The viscosities of the detergent compositions may be further varied by the addition of thickening agents such as gums and cellulose derivatives. The product viscosity and flow properties should be such as to make it pourable from a bottle and not so thin as to tend to splash or pour too readily, since usually only small quantities of the liquid detergent are to be utilized in use. Viscosities from 20 to 500 centipoises (Brookfield Viscometer) and found useful with those from 50 to 300 cps. being preferred and a viscosity of about 200 centipoises being considered best by most consumers, although at somewhat lower viscosities, e.g., 100 cps., consumer acceptance is almost the same.

In manufacturing the described formulations, usually it is preferred to heat the detergent constitutents to a somewhat elevated temperature, e.g., 40° to 50° C. and then admix them with the water and, optionally, all or a portion of the ethanol. Thereafter, other anionic and nonionic detergents, urea, amide, protein and other adjuvants are added with the more volatile materials, such as perfumes, preferably being added last and after cooling of the composition to about room temperature. Normally when making opaque or pearly detergents, the pearlizing mixture will also be added near last at about room temperature. Although the described method of making the compositions is preferred, various other known techniques may also be employed, depending upon the particular detergent composition.

Products of this invention, when tested against leading commercial hand dishwashing liquids in France by a panel of unbiased observers, were found to be significantly superior to them in consumer preference. In addition to having the most acceptable foaming characteristics, such as a low to moderate volume of persistent foam, and cleaning dishes well, the compositions were also found to be milder to the hands. It is considered that the desirable effects noted relate to the particular compositions described since other mixes of nonionic and anionic detergents may produce inadequate foam, fast disappearing foam, poor detergency or too much foam. Thus, the present balanced formulations give the desired cleaning and foaming effects and surprisingly, although the foam volume is mush less initially than that obtained by the use of commercial dishwashing liquids which contain sulfated ethoxylated higher fatty alcohol, it does not disappear during use as the dishwashing liquid is employed to clean dinnerware containing fatty and greasy deposits.

The following examples illustrate but do not limit the invention. Unless otherwise mentioned, all parts are by weight and all temperatures are in °C.

EXAMPLE 1

A pearlescent lotion is made of the following formula:

| | | Percent |
|---|---|---|
| * | Sodium $C_{14}$–$C_{17}$ paraffin sulfonate | 32 |
| | $C_{12}$–$C_{15}$ fatty alcohol condensed with a heteric mixture of ethylene oxide and propylene oxide (three ethylene oxide; one propylene oxide) so that the lower alkylene oxide is 75% by weight of the nonionic detergent | 9 |
| | Lauric myristic monoethanolamide | 2 |
| | Urea (technical) | 5 |
| | $MgSo_4 \cdot 7\ H_2O$ | 2 |
| ** | Soluble protein | 1 |
| *** | Pearlizing mixture | 8 |
| | Sodium ethylene diamine tetracetate sequestrant | 0.3 |

-continued

| | Percent |
|---|---|
| Perfume = 0.2%; Blue dye = 0.01% | 0.5 |
| Water, deionized | 40.5 |

* 26% $C_{14}$; 32% $C_{15}$; 25% $C_{16}$; and 14% $C_{17}$, containing less than 10% total of di- and polysulfonates (Hostapur SAS 60)
** Protopeptone WP-100-P - low molecular weight, enzyme hydrolyzed pork type collagen derivative, preserved with a mixture of benzalkonium chloride and methyl and propyl parahydroxybenzoic acid having a 0 Bloom value.
*** Tensiorex-BND (Tensia, Belgium) - about 1/3 each of higher fatty acid ester of polyethoxy ethanol, ($C_{12}$-$C_{18}$ and 1-10 epoxy group) coconut oil fatty acid alkanolamide and sodium lauryl ether sulfate.

The detergent components of this composition are mixed at a temperature of about 45° C. followed by addition of the other ingredients, with the perfume and pearlizing mixture being added after cooling of the rest of the mixture to room temperature. A portion of the water is employed to disperse and partially dissolve the pearlizing mixture before admixing with the rest of the formula.

The product made is a satisfactorily colored (blue) pearlescent liquid of attractive appearance and of a Brook-field viscosity of about 200 centipoises at room temperature. When tested against commercial French liquid dishwashing detergents, including "Lux", "Mir" and "Soleil", using one capful (about 5 ml.) per sinkful of dishwater, a panel of 90 consumers showed a decided and significant preference for the present composition. This is also true when it is compared with a similar product in which the nonionic detergent is replaced by ammonium higher alkyl polyethoxy ether sulfate, such as those commercially employed in dishwashing detergents.

In addition to the overall superiority of the present products, consumers particularly note the more desirable lower foam characteristics thereof, easy rinsability, good washing ability, desirable viscosity and mildness of the liquid dishwashing composition to the hand. In all these respects, the product is found superior to the commercial and other comparative products.

Comparable results are obtained when the pearlizing mixture, magnesium sulfate and urea are omitted. Similarly, substitution of coconut oil monoethanolamide or lauric myristic diethanolamide for the lauric myristic monoethanolamide results in a desirable product. Variations in the proportions of the anionic and nonionic detergents and of the alkanolamide within the ranges of proportions and percentages previously said to be preferred result in improved products of the desired foaming and cleaning properties.

EXAMPLE 2

| | | |
|---|---|---|
| * | Sodium linear $C_{10}$-$C_{12}$ alkyl benzene sulfonate | 22 |
| ** | Nonionic detergent | 23 |
| | Lauric myristic monoethanolamide | 3 |
| | Ethanol, denatured | 2.5 |
| | Urea | |
| *** | Soluble protein hand care agent | 1 |
| **** | Sequestrant, perfume, dye | 0.5 |
| | Water | 43.0 |

* 1% $C_9$, 13% $C_{10}$, 50% $C_{11}$, 28% $C_{12}$, 8% $C_{13}$ (Petrelab-500)
** Tertiary butyl ether of tertiary octyl phenoxy polyethoxy ethanol (11.5 ethoxy groups)
*** Lipoproteol-LCO (Rhone-Poulenc)
**** See Example 1

The product of this example is made in the way described above except for the fact that no pearlizing agent of magnesium sulfate is utilized and ethanol is employed. The ethanol is added after cooling of the product to room temperature. The product resulting is a stable clear liquid having a viscosity of about 100 centiposes at room temperature and a pH of about 7 (5-9 are satisfactory).

When employed as a liquid dishwashing ingredient, in the same manner as in Example 1, utilizing about a capful (five ml.) per sinkful of dirty dishes, the product produces a medium to medium-low foam volume and, like the product of the first example, washes a multiplicity of greasy and fat covered dishes, often as many as 20 to 30, before disappearance of the foam. It rinses easily from the dishes and does not obscure the surfaces thereof from view of the housewife. The sink is easily rinsed down after dishwashing and afterward contains little or no fatty scum or lining on the side walls thereof. The product is mild to the hands and consumers remark about this after about a week's use in daily dishwashing.

When the nonionic detergent is replaced by that of Example 1 a suitable product is also obtained, as is the case when up to 50% of the lauric myristic monoethanolamide is replaced by lauric myristic isopropanolamide, lauryl dimethyl amine oxide or triethoxylated lauric myristic monoethanolamide. Similarly, when the proportions of anionic and nonionic detergents are varied within the range of 0.9 to 4, products are obtained which also are better than the high foaming anionic liquid detergents. This is true too, when $C_1$-$C_3$ alkyl substituted benzene sulfonate hydrotropes, e.g., 0.5 to 5% of sodium benzene sulfonate or comparable toluene, cumene or xylene sulfonates are employed.

EXAMPLE 3

| | Percent |
|---|---|
| Sodium paraffin sulfonate (Hostapur SAS 60, Hoechst) | 34 |
| Tertiary butyl ether of tertiary octyl phenoxy polyethoxy ethanol (11.5 epoxy groups) | 9 |
| Lauric myristic monoethanolamide | 2 |
| Water | 55 |

The above clear liquid formulation is made by mixing the various components with water at room temperature. When the product is tested against a similar formula in which the nonionic detergent is replaced by the same amount of ammonium $C_{12-15}$ higher fatty alcohol triethenoxy ether sulfate or the comparable sodium salt thereof using 0.05% of the dishwashing detergent in water of 300 p.p.m. hardness, as calcium carbonate, 65 milliliters of foam are obtained with the experimental composition and 150 ml. with the control, by Ross-Miles foam tests. In washing miniplates previously soiled with Crisco (hydrogenated cottonseed oil), employing 0.15% of the liquid detergent, 59 and 55 plates are washed in 50 p.p.m. and 300 p.p.m. hardness water, respectively, while the comparable figures for the control are 52 and 58. At 0.075% detergent concentration the comparable figures are 34 and 31, and 25 and 31 at 50 and 300 p.p.m. each, respectively. The number of plates washed is that number washable while there is still the appearance of foam on top of the wash water. Thus, it is seen that the experimental composition washes about as well as or better than the control compositions although it starts with much less foam.

In a variation of this experiment the proportions of the paraffin sulfonate, nonionic and lauric myristic monoethanolamide are varied to 30, 8 and 2%, with water being the balance of the composition and similar tests are repeated. In these the experimental formula yields 25 ml. of foam compared to 135 ml. of foam, in the Ross-Miles foam test. In miniplate dishwashing at 0.1% the experimental washes 53 and 49 dishes, compared to 47 and 52 for the control, whereas at 0.075% the figures are 31 and 28, respectively, for both compositions.

In the above formulas different levels of viscosity, 100 to 200 cps. at 25° C., are obtained by adjusting contents of solubilizers in the formulations so that the viscosities are 100 and 200 cps. at 25° C. Apparently the foaming results and ultimate consumer preferences are not dependent on concentration.

The above formulations may be modified by replacement of the paraffin sulfonate with linear alkyl benzene sulfonate and by replacement of the nonionic with the condensate previously discussed and the products resulting are useful and improved persistently low foaming dishwashing detergents, suitable for dishwashing and preferred by the consumer over conventional commercial liquid dishwashing products.

The invention has been described with respect to examples and illustrations thereof but is not to be limited to these inasmuch as it will be evident that one of ordinary skill in the art with the present disclosure before him will be able to utilize substitutes and equivalents without departing from the spirit of the invention and the scope of the claims.

We claim:

1. A liquid dishwashing detergent having a medium or medium-low foam volume that is stable in the presence of grease soil which consists essentially of:

a. a detergent selected from the group consisting of 25% to 40% by weight of a water-soluble $C_{10}$–$C_{20}$ paraffin sulfonate, 15% to 30% by weight of a water-soluble linear $C_8$–$C_{15}$ alkyl benzene sulfonate, and 20% to 40% by weight of a mixture thereof;

b. 5% to 30% by weight of a nonionic detergent selected from the group consisting of a condensate of $C_{10}$–$C_{16}$ alkanol with a heteric mixture of ethylene oxide and propylene oxide in a weight ratio from 2.5:1 to 4:1 respectively, said condensate having a 60 to 85% content of ethylene oxide and propylene oxide, a $C_2$–$C_6$ alkyl ether of an ethoxylated $C_6$–$C_{10}$ alkyl phenol having 9 to 14 ethenoxy groups, and mixtures thereof;

c. 1% to 8% by weight of a $C_1$–$C_3$ alkanolamide of a $C_{10}$–$C_{16}$ alkanoic acid; and d. an aqueous medium; the total content of (a), (b), and (c) being from 35 to 50% by weight of the composition.

2. A clear light detergent according to claim 1 consisting essentially of from 15 to 30% by weight of sodium linear alkyl benzene sulfonate, 15 to 30% by weight of tertiary butyl ether of tertiary octyl phenoxy polyethoxy ethanol, 2 to 5% by weight of lauric myristic monoethanolamide, 2 to 8% by weight of urea and 1 to 5% by weight of ethanol.

3. A liquid detergent according to claim 1 wherein at least 80% of the paraffin sulfonate is of 12 to 18 carbon atoms, at least 80% of the alkyl group of the linear alkyl benzene sulfonate is of 9 to 13 carbon atoms, the anionic detergent is present as a salt or mixture of salts of alkali metal, ammonia, monoethanolamine, diethanolamine and triethanolamine, the alkanol-ethylene oxide-propylene oxide condensate has an alkylene oxide content of 70 to 80%, the lower alkyl of the lower alkyl ether of ethoxylated alkyl phenol is of 3 to 5 carbon atoms and the alkyl is of 7 to 9 carbon atoms, and the alkanoic acid of the alkanolamide is of 12 to 14 carbon atoms.

4. A liquid detergent according to claim 3 wherein at least 80% of the paraffin sulfonate is of 14 to 17 carbon atoms, at least 80% of the alkyl group of the linear alkyl benzene sulfonate is of 10 to 12 carbon atoms, the anionic detergent is present as an alkali metal salt, and the alkanol-ethylene oxide-propylene oxide condensate has at least 80% of alkanol of 12 to 15 carbon atoms.

5. A liquid detergent according to claim 3 wherein said aqueous medium includes up to 20% by weight of a solubilizer selected from the group consisting of urea, $C_2$–$C_3$ alcohol, $C_1$–$C_3$ alkyl substituted benzene sulfonate hyrotropes, and mixtures thereof.

6. A liquid detergent according to claim 5 which includes in addition 0.5 to 3% by weight of a water soluble protein hydrolysate having an average molecular weight of about 500 to 10,000.

7. A liquid detergent according to claim 6 consisting essentially of 25 to 40% by weight of sodium paraffin sulfonate, having an average molecular weight of 300 to 350, 5 to 15% by weight of alkanol-ethylene oxide-propylene oxide condensate, having an ethylene oxide: propylene oxide weight ratio of about 3:1, 2 to 5% weight of lauric myristic monoethanolamide, and 2 to 8% by weight of urea, and includes, in addition, 2 to 5% by weight of magnesium sulfate heptahydrate and 5 to 15% of a pearlizing mixture of $C_{10}$–$C_{18}$ fatty acid ester of polyethoxy ethanol containing 1 to 20 moles of ethylene oxide, $C_8$–$C_{18}$ fatty acid $C_2$–$C_3$ alkanolamide and sodium lauryl ether sulfate.

* * * * *